US010231499B2

(12) United States Patent
Lefrancois, Jr.

(10) Patent No.: US 10,231,499 B2
(45) Date of Patent: Mar. 19, 2019

(54) DISPOSABLE PROTECTIVE FINGER COVERS FOR USE WHILE EATING

(71) Applicant: Empial III, LLC, Cumberland, RI (US)

(72) Inventor: Michael P. Lefrancois, Jr., Cumberland, RI (US)

(73) Assignee: EMPIAL III, LLC, Cumberland, RI (US)

( * ) Notice: Subject to any disclaimer, the term of this patent is extended or adjusted under 35 U.S.C. 154(b) by 755 days.

(21) Appl. No.: 14/052,209

(22) Filed: Oct. 11, 2013

(65) Prior Publication Data

US 2014/0109284 A1 Apr. 24, 2014

Related U.S. Application Data

(60) Provisional application No. 61/820,764, filed on May 8, 2013, provisional application No. 61/717,143, filed on Oct. 23, 2012.

(51) Int. Cl.

| | |
|---|---|
| ***A41D 31/02*** | (2006.01) |
| ***A41D 1/00*** | (2018.01) |
| ***A41D 13/08*** | (2006.01) |

(52) U.S. Cl.

CPC ..... *A41D 31/02* (2013.01); *A41D 1/00* (2013.01); *A41D 13/087* (2013.01)

(58) Field of Classification Search

CPC ..... A41D 13/087; A61F 13/105

See application file for complete search history.

(56) References Cited

U.S. PATENT DOCUMENTS

| | | | | |
|---|---|---|---|---|
| 2,431,203 | A * | 11/1947 | Sebastian | 602/42 |
| 2,442,111 | A * | 5/1948 | Beardsley | 602/58 |
| 2,847,005 | A * | 8/1958 | Bourne | 602/58 |
| 3,529,597 | A * | 9/1970 | Fuzak | 602/58 |
| 4,860,736 | A * | 8/1989 | Kaitz et al. | 604/307 |
| 5,547,465 | A * | 8/1996 | Powell | 602/54 |
| 5,692,236 | A * | 12/1997 | Prince | 2/21 |
| 6,307,118 | B1 * | 10/2001 | Reich | 602/42 |
| D650,908 | S | 12/2011 | Robert | |
| 2003/0188369 | A1 * | 10/2003 | Stolf | 2/21 |
| 2004/0010217 | A1 * | 1/2004 | Blette et al. | 602/54 |
| 2006/0089585 | A1 * | 4/2006 | Takemura et al. | 602/58 |
| 2009/0062714 | A1 | 3/2009 | Trujillo et al. | |
| 2011/0137269 | A1 * | 6/2011 | Coubetergues et al. | 604/307 |
| 2012/0123312 | A1 * | 5/2012 | Tai | 602/54 |
| 2013/0138055 | A1 * | 5/2013 | Samlaska | 604/307 |
| 2014/0109284 | A1 * | 4/2014 | Lefrancois, Jr. | 2/69 |
| 2014/0215677 | A1 * | 8/2014 | Meltzner | 2/21 |

* cited by examiner

*Primary Examiner* — Andrew W Sutton

(74) *Attorney, Agent, or Firm* — Barlow, Josephs & Holmes, Ltd.

(57) ABSTRACT

A disposable protective cover for use on a finger while eating has a grease resistant flexible sheet that can be secured to a finger for repelling grease and sauces from foods being handled. The central body portion of the cover is approximately the same width and length as the finger. An upper tab extends from the upper end of the central body, and a lower tab extends from the lower end. A left tab and a right tab extend from the sides. The rear side of the sheet has an adhesive and a release sheet covering the adhesive. The user removes the release sheet to expose an adhesive on the rear surface, places the finger on the central body portion so that the lower tab extends onto the user's palm. The user then folds the upper tab over the fingertip and wraps the left and right tabs around the finger.

8 Claims, 9 Drawing Sheets

DISPOSABLE PROTECTIVE FINGER COVERS FOR USE WHILE EATING

CROSS REFERENCE TO RELATED APPLICATIONS

This application is related to and claims priority to earlier filed U.S. provisional patent application 61/717,143, filed Oct. 23, 2012, and U.S. provisional patent application 61/820,764, filed May 8, 2013, the entire contents of which are incorporated herein by reference.

BACKGROUND AND SUMMARY OF THE INVENTION

The instant invention relates to the food industry and more particularly to disposable products which help keep a diner's hand clean while eating messy food.

Keeping one's hands clean while eating messy food, such as chicken wings or ribs, has always posed a problem. Many food products are enjoyed by coating the food in a sauce, while gripping the food with one's fingers. Grease and sauce are easily transferred from the food to an individual's fingers. To remove the grease and sauce from the fingers, the person must often use several napkins. Plentiful napkins and wet wipes help with cleaning up the mess after the fact, but do not do much to prevent the problem.

Other foods pose similar problems. For example, some people are not able to use chopsticks easily or comfortably, so they may choose to eat sushi with their hands. Others may choose to enjoy eating lobster or other shellfish by using their fingers.

The present invention provides disposable protective finger covers, or sleeves, which will cover the wearer's thumb, index finger and middle finger of each hand. Preferably, the covers are fashioned from a grease resistant material, which will prevent the grease and sauce from these types of foods from penetrating through and onto the skin of the wearer.

Each disposable protective cover is provided to a user in the form of a sheet. A flexible sheet has a front surface and a rear surface. The front surface of the flexible sheet has a grease resistant surface for repelling grease and sauces from finger foods being handled by the user. The flexible sheet has an adhesive layer on at least a portion of its rear surface, and a release sheet extending over the adhesive before the cover is used.

Each flexible sheet is dimensioned and configured to be secured to a user's finger. The flexible sheet has a central body portion that is approximately the same length and width as the user's finger to which it is to be applied. To hold the cover on a user's finger, tabs extend from the central body portion so that they may be wrapped around a user's finger. An upper tab extends from the upper end of the central body portion; a lower tab extends from the lower end of the central body portion; a left tab extends from the left side of the central body portion; and a right tab extends from the right side of the central body portion.

When the user is ready to don the disposable cover, the user removes the release sheet from the rear surface to expose the adhesive. The user then places the palmar surface of a finger on the adhesive surface of the central body portion, with the fingertip being positioned at or near the upper end of the central body portion, and the lower tab of the sheet extending under the palm of the hand. The user then folds the upper tab over the fingertip, and wraps the left and right tabs circumferentially around the finger. The pressure sensitive adhesive adheres the sheet to the finger.

Based on the food that a user is eating, the user may want more or less of the skin on their finger to be covered by the protective cover. The protective cover may be configured to substantially enshroud the finger, or it may be configured to cover the portions of the finger most likely to come in contact with grease and sauce when the user is eating. The sheet may be dimensioned so that the left and right tabs have terminal end portions that overlap when the left and right tabs are extended circumferentially around the finger. The adhesive on one tab secures that tab to the finger, and the adhesive on the other tab secures the tabs to each other.

The cover may be dimensioned to cover any of the fingers on a user's hand. For example, a cover may be configured to be secured to a thumb, an index finger, or a middle finger. The covers may be provided as a set of covers dimensioned to be fitted to multiple fingers.

The cover may have one adhesive region on the rear surface, or it may have multiple adhesive regions on the rear surface. For example, there may be an adhesive region located toward the upper end of the cover and an adhesive region located toward the lower end of the cover.

Accordingly, among the objects of the instant invention are: the provision of disposable protective finger covers for preventing grease and sauce from messy finger foods from getting all over one's fingers and hands while eating.

Other objects, features and advantages of the invention shall become apparent as the description thereof proceeds when considered in connection with the accompanying photographs.

DESCRIPTION OF THE DRAWINGS

In the drawings which illustrate the best mode presently contemplated of carrying out the present invention.

DESCRIPTION OF THE PREFERRED EMBODIMENT

Figure 1:
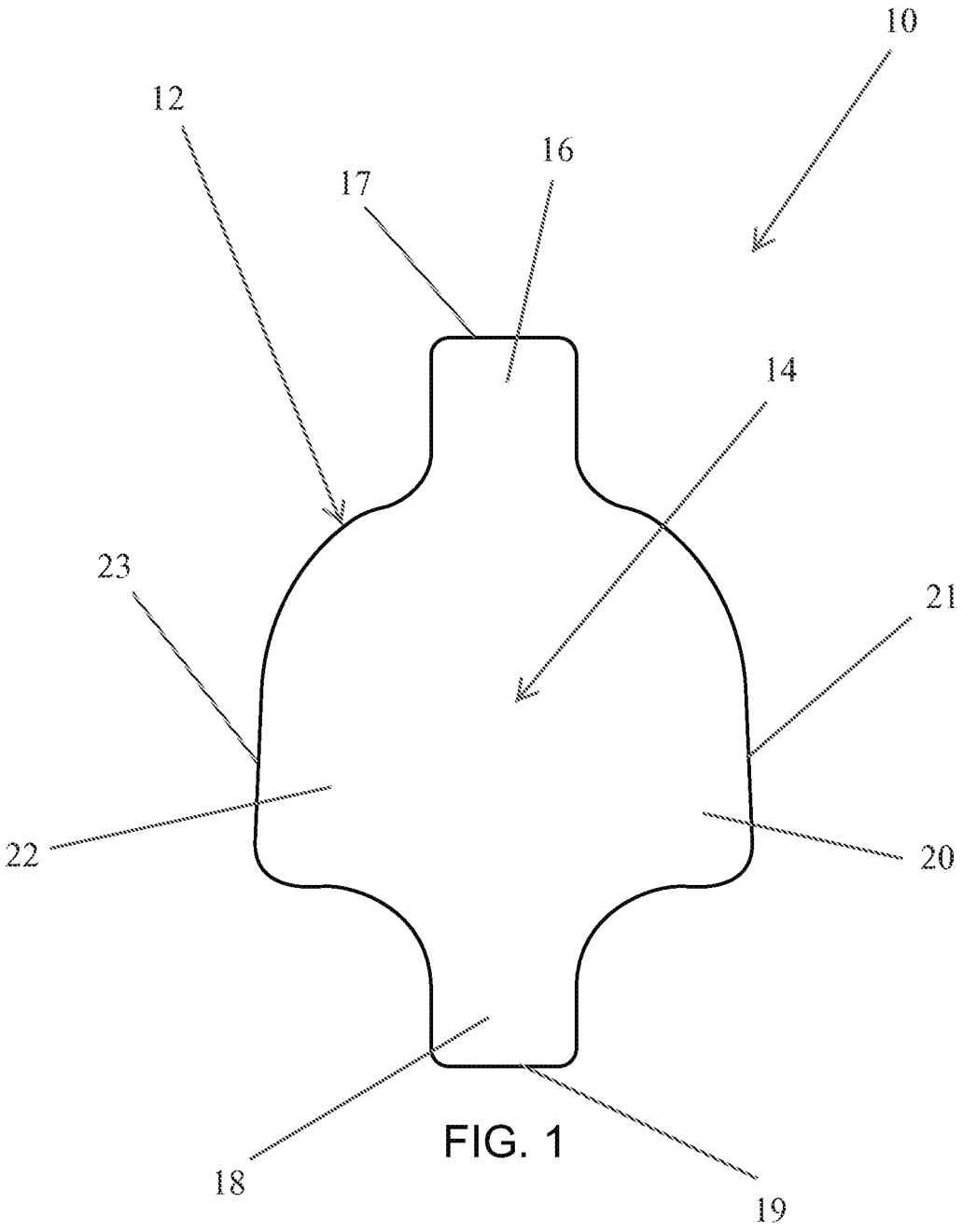
FIG. 1 is a front view of the disposable protective cover of the present invention.

Referring now to the drawings, the disposable protective cover of the instant invention is illustrated and generally indicated at 10 in FIGS. 1-9. As will hereinafter be more fully described, the instant disposable protective cover provides a grease resistant finger covering that helps keep fingers clean when a user eats finger food that is greasy or coated in a sauce. The disposable protective cover can be easily applied to a finger, and then easily and cleanly removed.

Figure 1A:
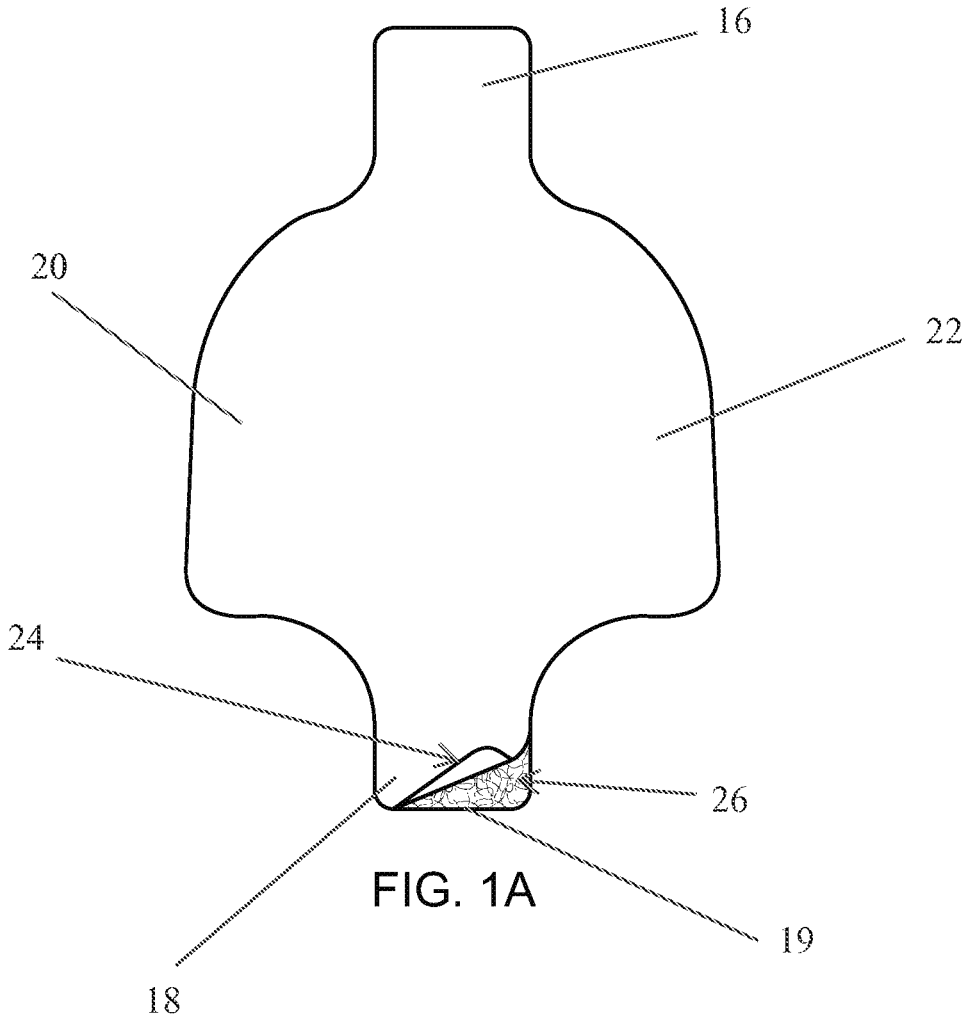
FIG. 1A is a rear view thereof with the release sheet partially peeled back from the lower tab.

FIGS. 1 and 1A show the disposable protective cover 10 as it is provided to a consumer. The disposable protective cover has a flexible sheet having a grease resistant front surface for repelling grease and sauces from food being handled by a user, as discussed in more detail below. To secure the protective cover to a finger, an adhesive layer coats at least a portion of the rear surface of the flexible sheet. Before use, a release sheet covers the adhesive layer.

The finger cover is roughly sized and configured to be comfortably wrapped around a user's finger, extending from the fingertip to the third knuckle, covering a majority of the finger and part of the palm. The cover may be provided as a one-size-fits-all product for fingers of men, women, adults, and children. Alternatively, the cover may be provided in a variety of sizes to fit different fingers of different sized hands. The cover has a flexible sheet that is preferably fashioned from an FDA approved grease resistant paper or other grease resistant material to prevent grease and sauce on foods from penetrating through the material and onto the user's skin.

The grease resistant material on the flexible sheet is preferably moisture resistant. This prevents grease and other liquids from being transferred from the food to skin covered by the flexible sheet.

In one embodiment, the grease resistant material on the flexible sheet is a synthetic fiber material. The grease resistant material may be high-density polyethylene fibers. In a preferred embodiment, the grease resistant material is made of olefin fiber sold under the trademark Tyvek®, a trademark of DuPont. The Tyvek® flexible sheet may be substantially the same thickness as a typical Tyvek® mailing envelope.

The flexible sheet is preferably substantially tear-proof and substantially puncture-proof. This is particularly advantageous when using one's fingers to handle shellfish.

Before eating, the user removes the adhesive backing from the flexible sheet, places a finger on the adhesive layer, and securely wraps the adhesive backed flexible sheet over the finger, as described in more detail below, repeating the process for each of their fingers and thumbs. The protective cover is flexible so that the user's fingers have sufficient range of motion to comfortably grasp and release objects, such as food items. When the user grasps an item having a grease-based or sauce-based coating, some of that coating will be transferred to the disposable protective covers. When done eating, the user simply peels the protective covers from the fingers and discards them.

FIG. 1 shows a front view of the flexible sheet 12 of the disposable protective cover in a flat orientation. The flexible sheet 12 has an elongated central body portion 14 that is dimensioned to have approximately the same length and width as a finger to which the sheet is to be applied, with tabs extending from the central body for securing the flexible sheet to a finger. An upper tab 16 extends from the upper end of the central body portion 14 to an upper terminal end 17, a lower tab 18 extends from the lower end of the central body portion 14 to a lower terminal end 19, a left tab 20 extends from the left side of the central body portion to a left terminal end 21, and a right tab 22 extends from the right side of the central body portion to a right terminal end 23. In the exemplary embodiment of FIG. 1, the left tab 20 and right tab 22 have substantially the same height as the central body portion 14, and the upper tab 16 and lower tab 18 have substantially the same width as the central body portion 14. The operation of the tabs will be discussed in more detail below.

In one embodiment, when the flexible sheet is flattened as shown in FIG. 1, the central body portion is roughly 1 inch wide, the overall width is 3.432 inches, and the length from the lower terminal end to the upper terminal end is 5 inches.

When the user is ready to don the disposable protective cover 10 on a finger, the user peels back the release sheet 24 from the adhesive layer 26, as shown at the lower tab in FIG. 1A. When the protective cover is provided to a user, the release sheet is positioned so that it extends over the pressure sensitive adhesive. The release sheet 24 is configured so that the adhesive layer 26 has a greater adhesion to the flexible sheet 12 than it does to the release sheet 24. This allows a user to remove the release sheet 24 from the adhesive layer 26, leaving the adhesive 26 on the flexible sheet 12. The release sheet 24 may be discarded after removal from the adhesive layer.

FIGS. 2-5 show the steps of applying the disposable protective cover 10 to a finger.

Figure 2:
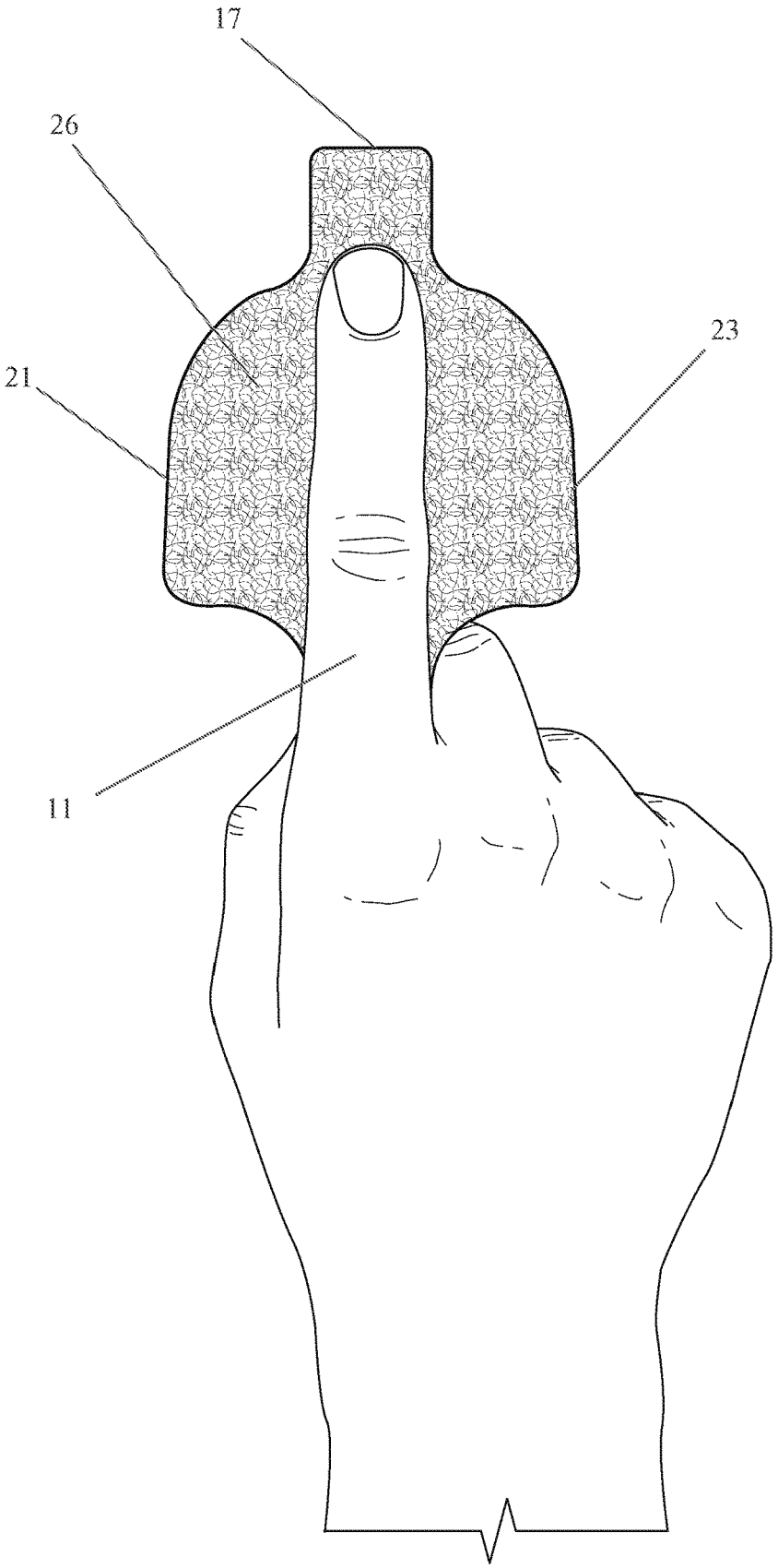
FIG. 2 is a rear view thereof with the release sheet removed and a finger extending over the central body portion.

With the release sheet 24 removed to expose the adhesive layer 26 on the rear surface of the flexible sheet 12, the user may place the flexible sheet 12 on a substantially flat surface. Then, the user extends the finger 11 to be covered by the flexible sheet 12, and places the palmar surface of the finger into facing engagement with the adhesive layer 26 on the rear surface of the flexible sheet 12, as shown in FIG. 2. The fingertip of the index finger 11 in FIG. 2 is adjacent to the upper end of the central body 14. The palm of the hand is placed over the lower tab 18. In this position, the adhesive on the rear surface of the central body portion 14 of the flexible sheet 12 secures the central body portion 14 to the palmar surface of the finger.

To further secure the flexible sheet to the finger, and to provide greater coverage of the surface area of the finger, the user folds the upper tab 16, right tab 22, and left tab 20 so that they wrap around the surface of the finger 11.

Figure 3:
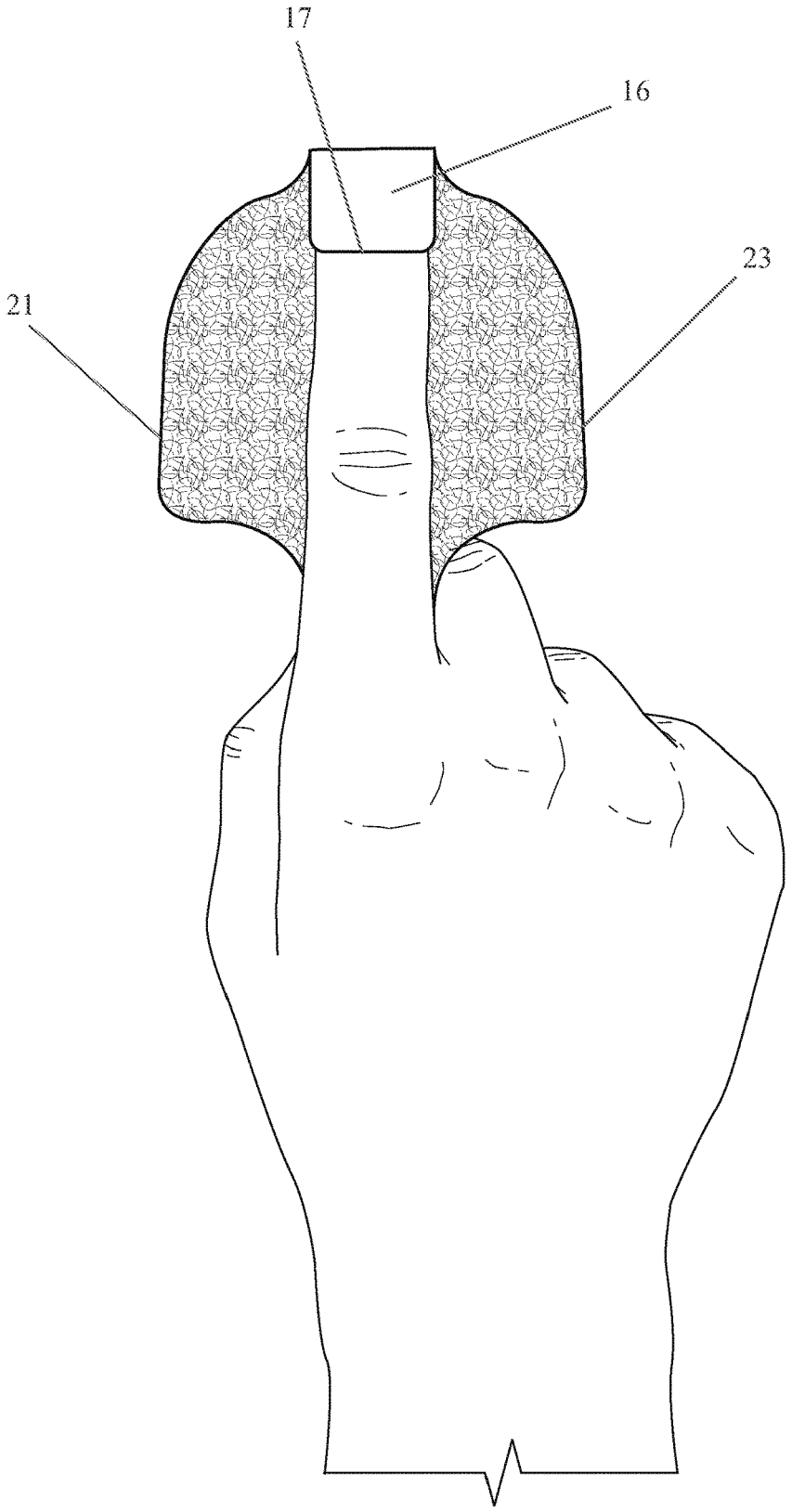
FIG. 3 is another view thereof with the upper tab folded over the fingertip.
Figure 4:
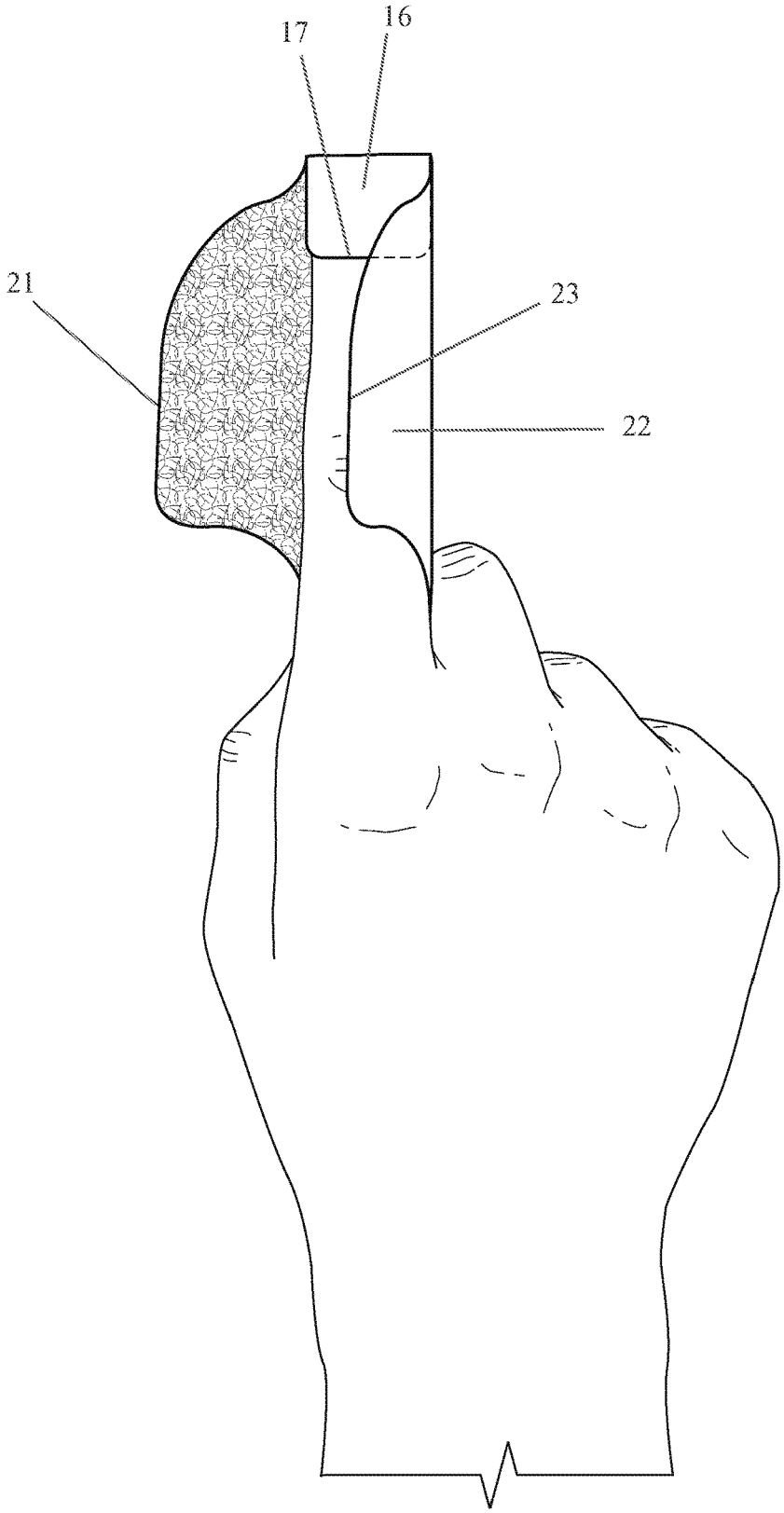
FIG. 4 is another view thereof with the right tab folded over the finger.
Figure 5:
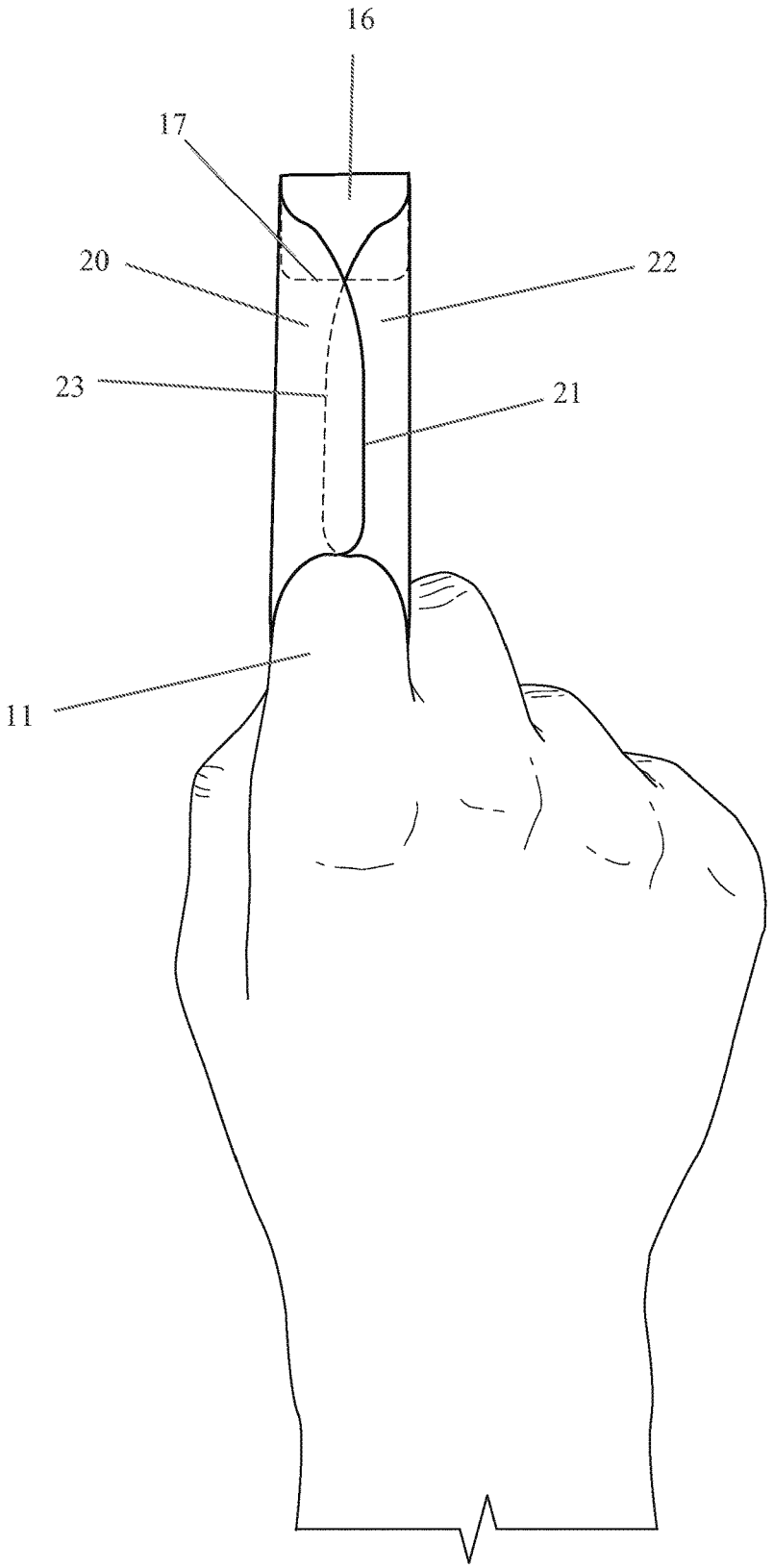
FIG. 5 is another view thereof with the left tab folded over the finger.
Figure 6:
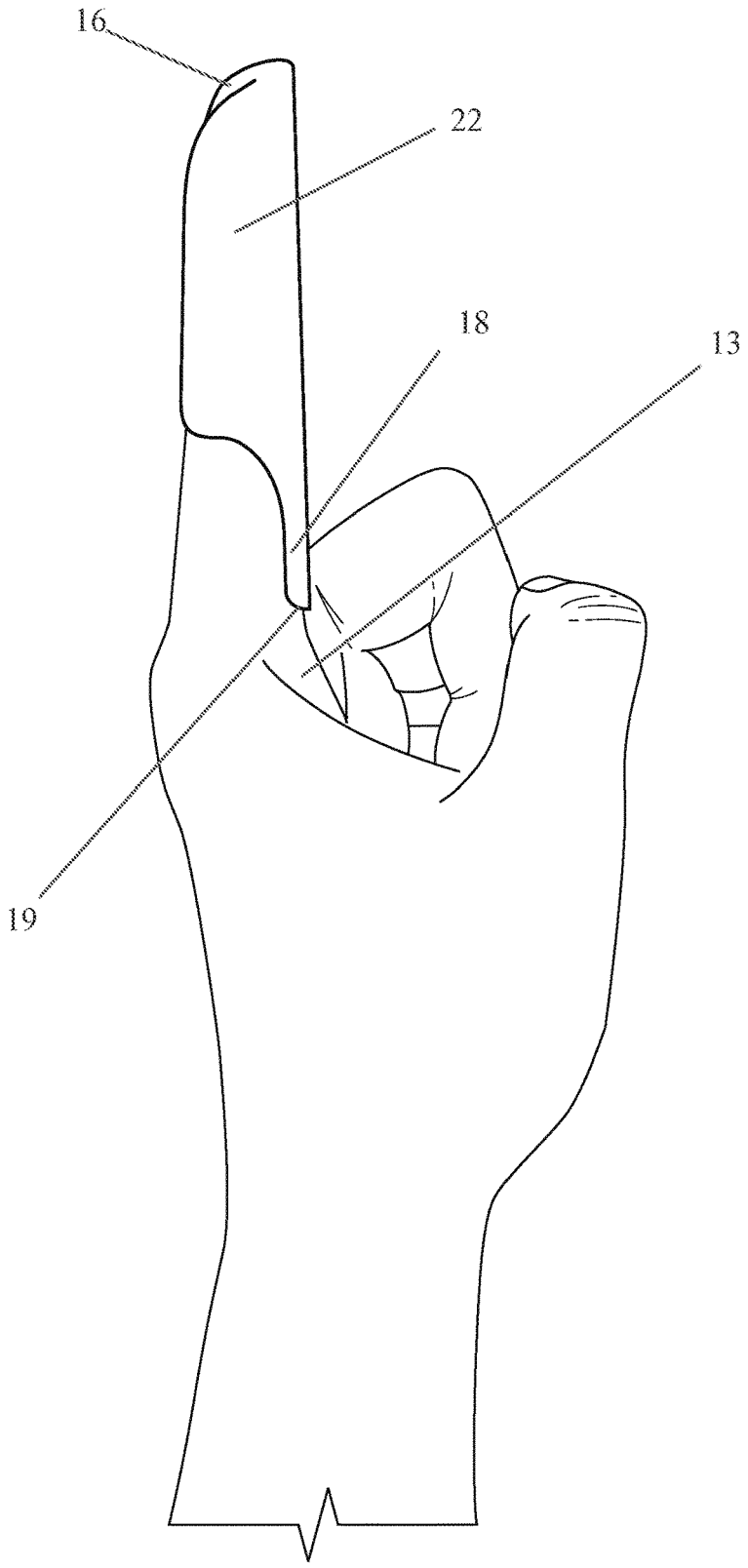
FIG. 6 is a side view of the disposable protective cover secured to a finger.
Figure 7:
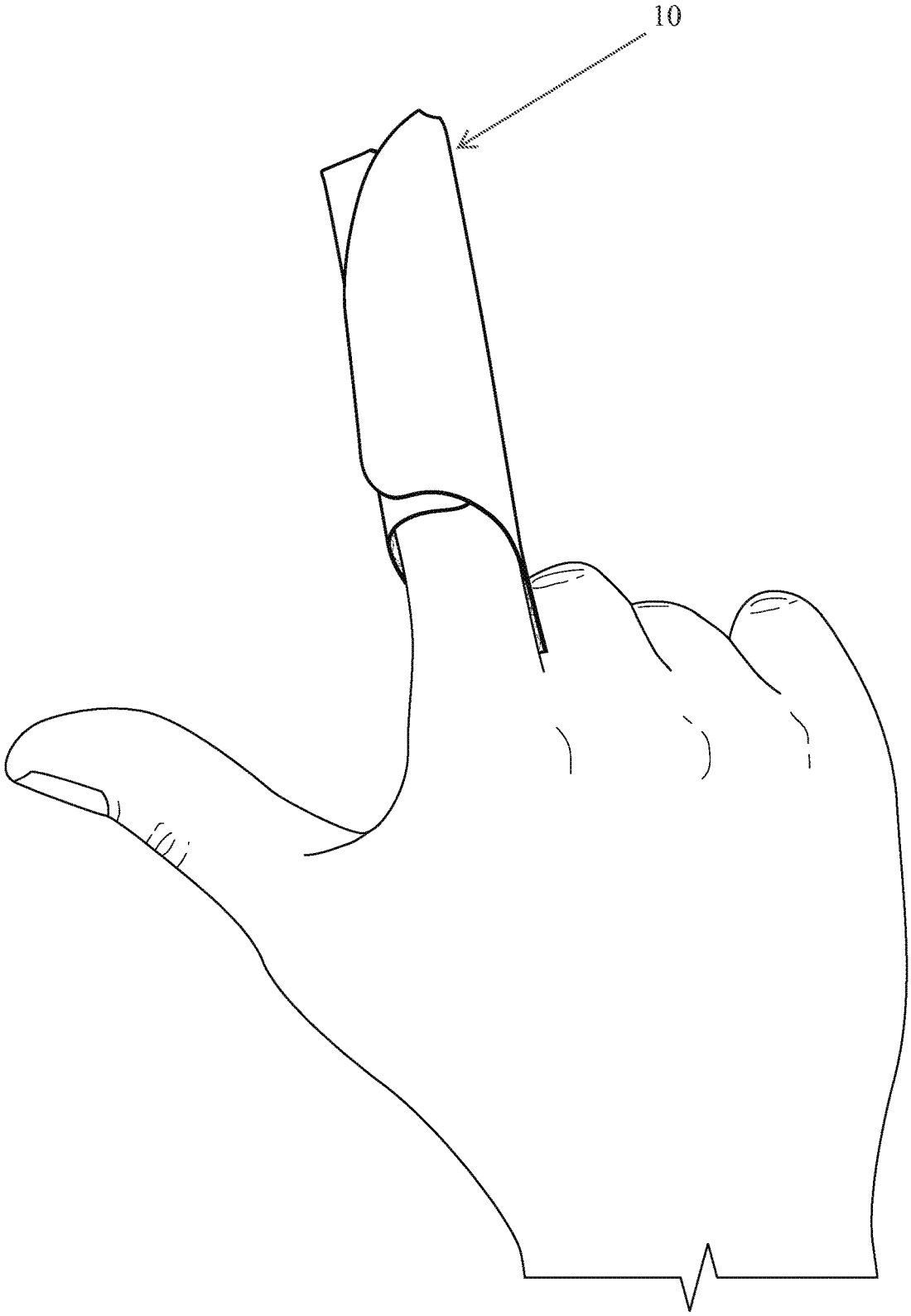
FIG. 7 is a perspective view thereof.

The user first folds the upper tab 16 over the finger tip, and the adhesive 26 holds the tab in place, as shown in FIG. 3. Next, the user circumferentially wraps the right tab 22 around the finger so that it extends onto the dorsal side of the finger, and over the upper tab 16, as shown in FIG. 4. Then, the user circumferentially wraps the left tab 20 around the finger so that it extends onto the dorsal side of the finger, and over the right tab 22, as shown in FIG. 5.

When secured to the finger, the grease resistant flexible sheet 12 covers the skin that is most likely to come into contact with grease and sauce when eating food. As seen in FIG. 5, the exemplary embodiment of the disposable protective cover covers the skin on the sides and back of the index finger 11, from the fingertip past the second knuckle. As seen in the side view of FIG. 6, the lower tab 18 of the flexible sheet 12 extends over the third knuckle, onto the palm 13 of the hand.

In the exemplary embodiment of the disposable protective cover, the terminal end portions 21, 23 of the left tab and right tab overlap when they are extended circumferentially around a finger, and the adhesive 26 secures the tabs to each other and to the finger to secure the cover on the finger. Thus, the disposable protective cover substantially enshrouds the finger from the fingertip down past the second knuckle when the upper tab, left tab, and right tab engage the finger.

Because the protective cover extends past the third knuckle on the palmar side of the finger and onto the palm, but does not extend past the third knuckle on the dorsal side of the finger, flexibility of the finger at the third knuckle is not decreased by the protective cover. Any change in flexibility at the other knuckles is insufficient to impede grasping and eating food.

Although the exemplary embodiment shows the entire rear surface of the flexible sheet being coated by an adhesive, it is possible to have an adhesive layer that only covers a region or regions on the rear surface. For example, there could be a first adhesive layer applied toward the upper end of the central body portion on the rear surface of the flexible sheet, and a second adhesive layer applied toward the lower end of the central body portion on the rear surface of the flexible sheet.

The adhesive layer may be formed of a pressure sensitive adhesive or another adhesive.

Figure 8:
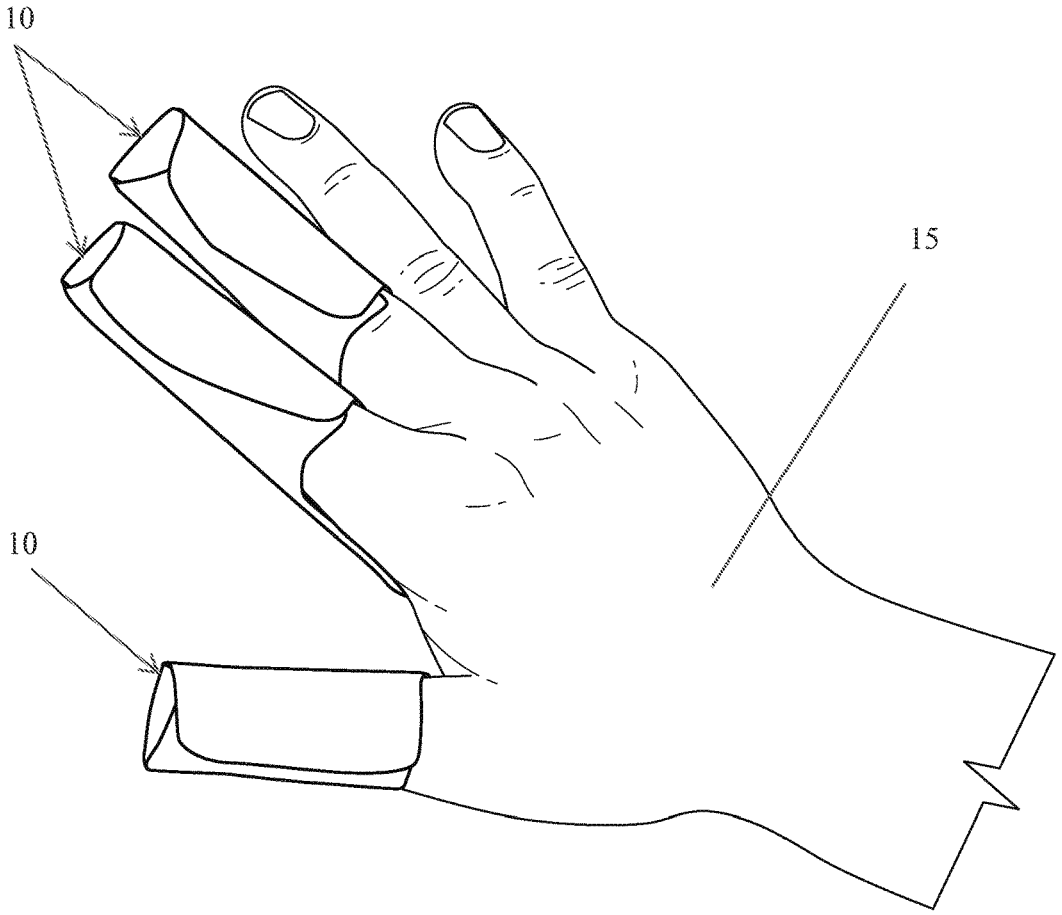
FIG. 8 is a perspective view of a set of disposable protective covers secured to a thumb, an index finger, and a middle finger.
Figure 9:
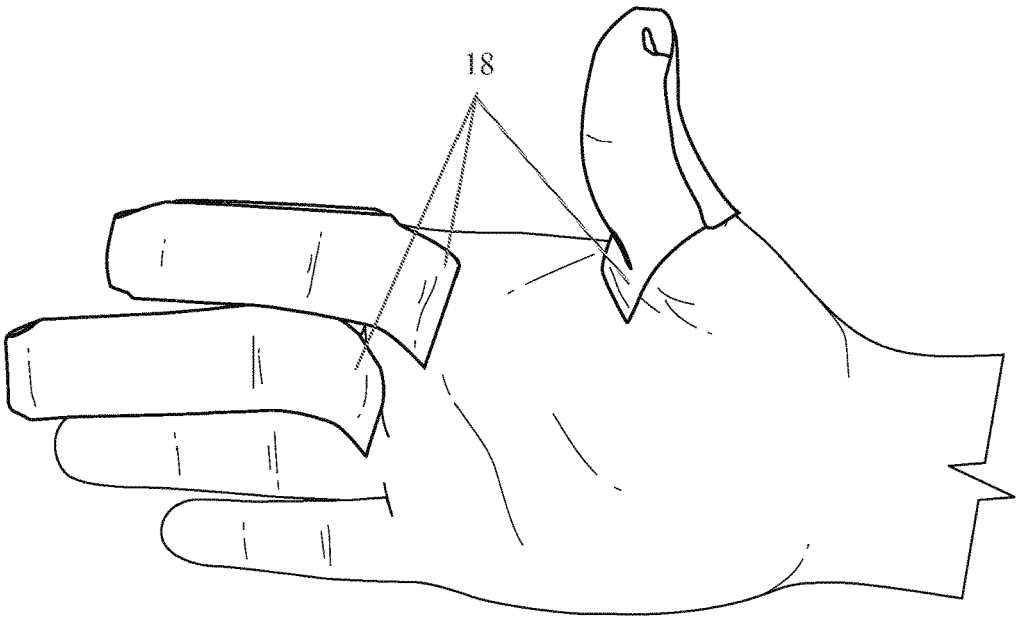
FIG. 9 is another view thereof.

The protective cover can be dimensioned to cover any finger. For example, a protective cover could be dimensioned to cover a thumb, an index finger, or a middle finger. Additionally, the disposable protective covers could be provided as a set of covers for covering multiple fingers on a hand. For example, a set of six disposable protective covers could be provided to a user so the user can apply a protective cover to the thumb, index finger, and middle finger on each hand. FIGS. 8 and 9 show disposable protective covers 10 applied to three fingers on a hand 15.

It can therefore be seen that the present invention provides a disposable protective finger cover for preventing grease and sauce from messy food from getting all over one's fingers and hands while eating. The finger cover reduces the amount of grease and sauce transferred from food to a user's hands while dining, thus significantly reducing the amount of cleanup needed thereafter. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A disposable protective cover for use on a user's finger while said user is eating, the cover comprising:

a flexible sheet having a front surface, a rear surface, and an elongated central body portion;

the central body portion having an upper end, a lower end, a left side, and a right side;

the elongated central body portion having approximately the same length and width as the finger;

said flexible sheet further having an upper tab extending longitudinally from the upper end of the central body portion;

a lower tab extending longitudinally from the lower end of the central body portion;

a left tab extending from the left side of the central body portion;

a right tab extending from the right side of the central body portion;

a pressure sensitive adhesive covering at least one adhesive region on the rear surface of the flexible sheet; and a release sheet received over the pressure sensitive adhesive, said front surface of said flexible sheet being a grease resistant surface for repelling grease and sauces from food being handled by the user, said cover being configured and arranged to be donned on the user's finger with the release sheet removed from the rear surface to expose the adhesive, the user's finger placed onto the central body portion with a fingertip adjacent the upper end thereof and the lower tab extending onto a palm of the user, the upper tab folded over the fingertip, and the left and right tabs wrapped circumferentially around the finger, said pressure sensitive adhesive adhering the central body portion and the respective tabs to the finger to maintain the cover on the finger.

2. The disposable protective cover of claim 1, wherein terminal end portions of the left tab and right tab extend outwardly so that they overlap when they are extended circumferentially around a finger, said pressure sensitive adhesive adhering the respective tabs to the finger and to each other to maintain the cover on the finger.

3. The disposable protective cover of claim 2, wherein the cover substantially enshrouds the finger when the upper tab, left tab, and right tab engage the finger.

4. The disposable protective cover of claim 3, wherein the cover is dimensioned to cover a finger selected from the group of: a thumb, an index finger, and a middle finger.

5. The disposable protective cover of claim 4, wherein the grease resistant surface of the flexible sheet comprises a synthetic fiber material.

6. The disposable protective cover of claim 5, wherein the grease resistant surface of the flexible sheet is also moisture resistant.

7. The disposable protective cover of claim 6, wherein the flexible sheet is substantially tear-proof and substantially puncture-proof.

8. A set of disposable protective covers for fingers, each finger extending from a palm of a hand to a fingertip, the set of covers comprising:

a first cover dimensioned to be applied to a thumb;

a second cover dimensioned to be applied to an index finger;

a third cover dimensioned to be applied to a middle finger;

wherein each of the covers further comprises:

a flexible sheet having a front surface, a rear surface, and a central portion;

the central portion having an upper end, a lower end, a left side, and a right side;

the central portion having approximately the same length and width as the finger selected from one of the group of: a thumb, an index finger, and a middle finger;

an upper tab extending longitudinally from the upper end of the central portion;

a lower tab extending longitudinally from the lower end of the central portion;

a left tab extending from the left side of the central portion;

a right tab extending from the right side of the central portion; and a pressure sensitive adhesive covering at least one adhesive region on the rear surface of the flexible sheet;

wherein the front surface of the flexible sheet is a grease resistant surface; and further wherein the cover is configured so that when the finger is placed on the central portion so that it extends from the lower end to the upper end, the lower tab extends onto the palm of the hand, the upper tab may be folded over the fingertip, and the left and right tabs may be wrapped circumferentially around the finger.

* * * * *